United States Patent [19]

Tarlow et al.

[11] Patent Number: 4,723,326

[45] Date of Patent: Feb. 9, 1988

[54] WEIGHTED SHOWER CURTAIN

[75] Inventors: Kenneth A. Tarlow, Playa del Rey, Calif.; Barbara D. Arner, 1901 Polaris Dr., Gendale, Calif. 91208

[73] Assignee: Barbara D. Arner, Oxnard, Calif.

[21] Appl. No.: 946,528

[22] Filed: Dec. 23, 1986

[51] Int. Cl.[4] ..... A47K 3/22

[52] U.S. Cl. ..... 4/608; 4/607; 4/610; 160/349 R

[58] Field of Search ..... 4/608, 610, 661; 160/349 D, 349 R

[56] References Cited

U.S. PATENT DOCUMENTS

| | | | |
|---|---|---|---|
| 2,120,155 | 6/1938 | Shera | 4/608 |
| 2,148,401 | 2/1939 | Ellis, Jr. | 4/608 X |
| 2,212,326 | 8/1940 | Piken | 4/608 X |
| 3,000,016 | 9/1961 | Ridge | 4/608 X |
| 3,107,361 | 10/1963 | Glutting, Sr. | 4/608 X |
| 3,282,328 | 11/1966 | Mushro et al. | 4/608 X |
| 3,365,684 | 1/1968 | Stemke et al. | 4/608 X |

*Primary Examiner*—Henry K. Artis

*Attorney, Agent, or Firm*—Poms, Smith, Lande & Rose

[57] ABSTRACT

A weighted shower curtain is disclosed having an elongated flexible shower curtain adapted to be hung in a shower. A plurality of separate independent weights are provided which snap fit on to the bottom of the shower curtain without damaging the same and are quickly and easily removable therefrom. The weights may be sealed in plastic and keep the shower curtain in a fixed hanging position when in use preventing flapping thereof.

8 Claims, 3 Drawing Figures

WEIGHTED SHOWER CURTAIN

BACKGROUND OF THE INVENTION

The invention relates to shower curtains; and, more particularly, to a weighted shower curtain having a plurality of spaced weights at the bottom thereof.

FIELD OF THE INVENTION

Shower curtains are used to prevent water when showering from splashing outside of the shower stall or tub in which the shower is located. Such curtains are generally hung on rods above the shower head between the stall or tub and the exterior thereof. The shower curtain is generally of a flexible material, transparent, opaque or translucent, and of various kinds of materials but preferably waterproof. Vinyl plastics are popular for use in such curtains.

The disadvantages of such curtains is that, in order to be waterproof and hang from a rod, they are generally of a relatively light weight material. However, steam produced during showering creates an air current drawing in cold air under the curtain blowing the same towards the person showering thereby rendering them cold and uncomfortable. This may also allow water to go onto the tile, rug or carpeting outside of the shower stall or tub. Needless to say, such moisture is undesirable for safety reasons since it can make the wetted area slippery or unsafe and can also damage the same over time causing rot and mildew.

There is thus a need for a way to quickly and easily weight down the bottom of such shower curtains so they stay in place while showering. Such means should be easily to add to, or remove from, a pre-existing shower curtain and easy and inexpensive to manufacture.

SUMMARY OF THE INVENTION

It is an object of this invention to provide a weighted shower curtain.

It is a further object of this invention to provide a shower curtain having removable weights at the bottom thereof.

It is still further an object of this invention to provide a weight which can be quickly and easily added to the bottom of a shower curtain, then removed therefrom when desired.

These and other objects are preferably accomplished by providing a weighted shower curtain having an elongated flexible shower curtain adapted to be hung in a shower. A plurality of separate independent weights are provided which snap fit on to the bottom of the shower curtain without damaging the same and are quickly and easily removable therefrom. The weights may be sealed in plastic and keep the shower curtain in a fixed hanging position when in use preventing flapping thereof.

DESCRIPTION OF THE PREFERRED EMBODIMENT

Figure 1:
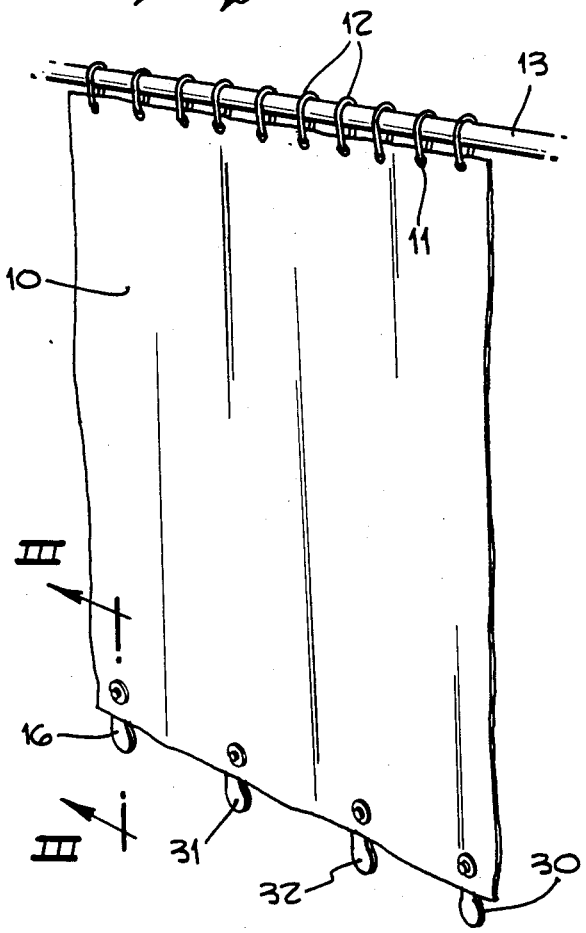
FIG. 1 is a perspective view of a shower curtain having apparatus mounted thereon in accordance with the teachings of the invention.

Referring now to the drawing, a conventional shower curtain 10 is shown having a plurality of apertures 11 at the top receiving rings 12 therein hanging from a pole or rod 13. It is to be understood that curtain 10 may be of a flexible material, opaque, transparent or translucent, and is installed in a shower stall or tub or the like.

Figure 2:
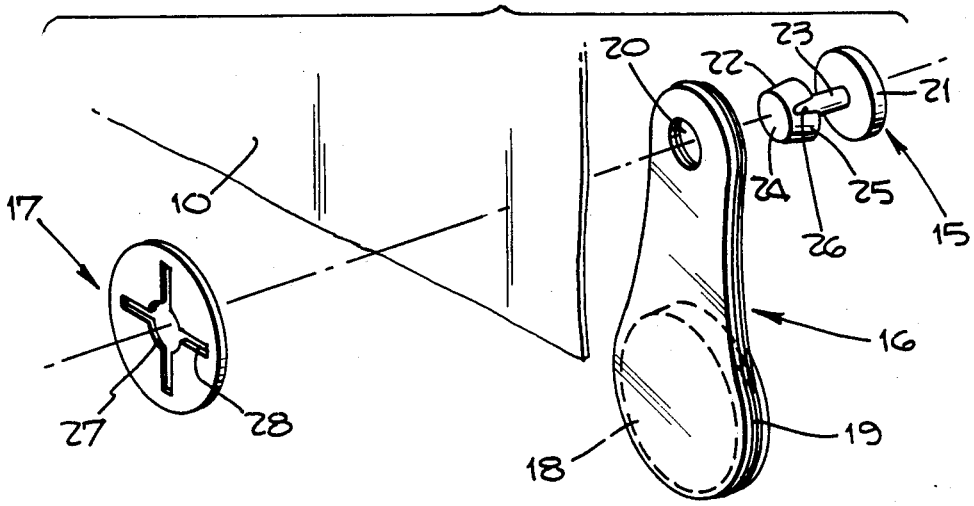
FIG. 2 is an exploded view of the apparatus of the invention prior to mounting to the lower end of the curtain of FIG. 1.

As shown in FIG. 2, a weight 14 is provided comprised of a snap 15, a weighted pouch 16, and a lock member 17. Pouch 16 may be a hollow pouch having one or more internal metallic weighted elements 18, (see also FIG. 3) such as lead, and sealed about the outer rim 19 thereof. An aperture 20 is provided at the upper end. Preferably, pouch 16 is configured such that it has a bulbous bottom portion with weighted element 18 therein and a narrower upper portion with aperture 20 extending therethrough. Pouch 16 is of any suitable material, such as vinyl, and, if so, rim 19 is preferably heat sealed. This protects the weighted element from rusting and the like and renders pouch 16 impervious to moisture.

Snap 15 includes a button portion 20 at one end, larger in outer diameter than aperture 20, and an insert portion 22 at the other end interconnected to button portion 21 by a shaft portion 23. Insert portion 22 may have a smaller diameter button portion 24 and an inwardly extending peripheral shirt 25 slit at spaced locations as at slit 26. Preferably, snap 15 is of a resilient plastic material and preferably molded from one unitary piece. Button portion 24 is of a diameter small enough to enter aperture 20 with skirt 25 being squeezed via slits 26 so as to pass therethrough as will be discussed.

Lock member 17 may be a washer or annular member having a central hole 27 and a series of spaced slits 28 extending radially outwardly from hole 27. Member 17 may also be of a plastic material, slits 28 allowing the member 17 to open slightly when snap 15 is inserted therethrough as will be discussed.

Figure 3:
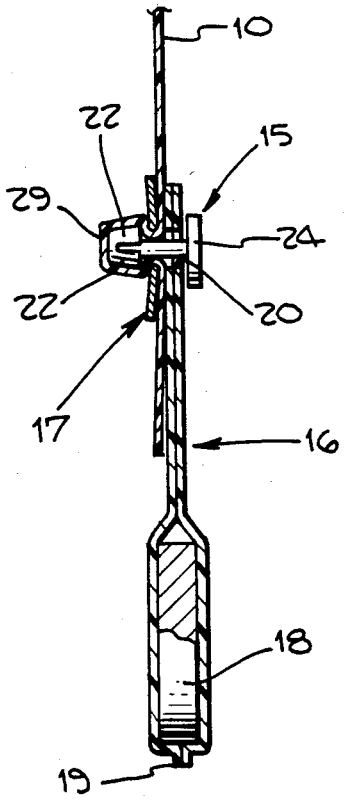
FIG. 3 is a side sectional view of the final assembly of the apparatus of FIG. 1.

In use, the button portion 24 of snap 15 is inserted into aperture 20 of weight 16 and into the material of shower curtain 10 at any desired position adjacent the bottom forming thereof a pocket 29 in curtain 10 as seen in FIG. 3. Skirt 25 passes through aperture 20 allowing weight 16 to be disposed between skirt 25 and button portion 24 as seen in FIG. 3. The member 17 is now inserted over the material in the pocket 29 in curtain 10 and about skirt 25 to thereby firmly lock the weight 16 in position at the bottom of the curtain 10. Obviously, more than one such weight 16 may be provided such as the weights 30 through 32 shown in position in FIG. 1.

It can be seen that we have disclosed an inexpensive weight that can be quickly and easily added to a pre-existing shower curtain to provide a weighted bottom. One or more such weights may be provided and at any desired location but preferably near the bottom of the curtain. The weights can be quickly and easily removed by squeezing skirt 25 and pulling member 17 off of the snap 15.

The shower curtain can be provided with the weights or the weights can be an after market item to be added to any shower curtain, then removed and reused if it is desired to replace the curtain. Any suitable materials, may be used but plastics are preferably where applicable. The envelope containing the weighted element may be of any suitable configuration.

The invention is not to be limited by the disclosure herein but defined by the scope of the appended claims.

We claim:

1. A shower curtain comprising: a flexible shower curtain; a weighted element having a weight and weighted element connecting means removable connecting the weight to the bottom of the curtain, said weight including a bottom weighted and an upper apertured portion, said weighted element connecting means including a first button member of an outer diameter greater than the diameter of said aperture in said apertured portion, a second button member interconnected to said first member and of an outer diameter less than the diameter of said aperture in said apertured portion, a skirt extending about the periphery of said second button member toward said first button member with a plurality of spaced slits therein, an apertured fastener having an annular main body portion with a plurality of slits extending radially outwardly from the aperture therein, said aperture in said apertured fastener being generally related to the diameter of said second button member whereby said second button member can be inserted through the aperture in said apertured fastener, said fastener passing over and squeezing said skirt and being finally disposed between said skirt and said first button member.

2. A weight adapted to be removably attached to the bottom of a shower curtain comprising:

a main body portion having an outer envelope of a water impervious material and hollow on the interior, said envelope having a lower bulbous portion with a weight element loosely disposed therein and an integral upper portion having an aperture therein, said envelope being sealed about the outer periphery thereof; and a fastener having a first part with a first button member of an outer diameter slightly less than the diameter of said aperture and a second button member connected to said first button member but spaced therefrom and of an outer diameter greater than the diameter of said aperture, a skirt extending about the periphery of said first button member toward said second button member and spaced therefrom, said fastener comprising a second part including a main body portion having an aperture therein substantially the same diameter as said first button member whereby said first button member is insertible into the aperture in the aperture in said upper portion, said second button member preventing said first part from going all the way through said aperture in said upper portion, said upper portion occupying the space between said skirt and said second button member the aperture of said second part being insertible over said first button member and abutting against said first portion in the space between said second button member and said skirt, said skirt preventing withdrawal of said second part away from said second button member.

3. In the weight of claim 2 wherein said second part is an annular washer of a flexible material having a plurality of spaced radially extending slits therein extending outwardly away form the aperture therein.

4. In the weight of claim 3 wherein said washer is of plastic material.

5. In the weight of claim 2 wherein said skirt is of a flexible material having a plurality of spaced slits extending about the periphery thereof.

6. In the weight of claim 5 wherein said first part is one integral piece of plastic material.

7. In the weight of claim 2 wherein said weighted element is of a metallic material.

8. In the weight of claim 2 wherein said envelope is of a vinyl material heat sealed about the outer periphery thereof.

* * * * *